US006250563B1

(12) United States Patent
Frank et al.

(10) Patent No.: US 6,250,563 B1
(45) Date of Patent: Jun. 26, 2001

(54) FUEL INJECTION VALVE FOR INTERNAL COMBUSTION ENGINES

(75) Inventors: Wilhelm Frank, Bamberg; Gerd Schmutzler, Kareth; Joachim Wagner, Beilngries; Hartmut Gross, Lengenfeld, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/494,404

(22) Filed: Jan. 28, 2000

Related U.S. Application Data

(63) Continuation of application No. PCT/DE99/01578, filed on May 28, 1999.

(30) Foreign Application Priority Data

May 28, 1998 (DE) ..... 198 23 935

(51) Int. Cl.[7] ..... F02M 47/02
(52) U.S. Cl. ..... 239/88; 239/570
(58) Field of Search ..... 239/88, 900, 570; 251/84, 85, 333, 129.06; 29/890.142

(56) References Cited

U.S. PATENT DOCUMENTS 4,074,700 * 2/1978 Engle ..... 251/84
5,564,469 * 10/1996 Tremoulet, Jr. et al. ..... 251/333

FOREIGN PATENT DOCUMENTS 36 27 865 A1 2/1988 (DE) .
0 615 064 A1 9/1994 (EP) .
753 660 A1 1/1997 (EP) .
0 816 670 A1 1/1998 (EP) .

* cited by examiner

*Primary Examiner*—Lisa Ann Douglas
(74) *Attorney, Agent, or Firm*—Herbert L. Lerner; Laurence A. Greenberg; Werner H. Stemer

(57) ABSTRACT

An actuator is operatively connected to a closing member via a tappet. The closing member is introduced in a valve chamber and forms, with a conically tapering valve seat as part of a servovalve, a seal resistant to high pressure. The cross section of the closing member is configured to be mushroom-shaped, a closing head being in the form of a part-sphere and having a central flattening, with the result that the tappet has an enlarged bearing surface. A stem of the closing member is surrounded by a valve spring. The closing member is preferably shaped out of a solid sphere.

11 Claims, 3 Drawing Sheets

FUEL INJECTION VALVE FOR INTERNAL COMBUSTION ENGINES

CROSS-REFERENCE TO RELATED APPLICATION

This is a continuation of copending International Application PCT/DE99/01578, filed May 28, 1999, which designated the United States.

BACKGROUND OF THE INVENTION

Field of the Invention

The invention relates to a fuel injection valve having a control chamber that is connected to an inflow duct. A pressure in the control chamber is operatively connected to a nozzle needle and the pressure in the control chamber controls the nozzle needle. A servovalve having a closing body and an associated valve seat is disposed between the control chamber and a return duct. In a closed position, in which the closing body is moved by an actuator, the closing body closes an outflow of the fuel injection valve.

Such a fuel injection valve is known from Published, European Patent Application EP 0 816 670 A1. The known fuel injection valve contains a servovalve which serves for bringing about hydraulically the opening and closing of the fuel injection valve, in particular for defining the start and end of the injection operation exactly in time. A spherical closing body is introduced in the valve chamber of the servovalve and is operatively connected to an actuator via a tappet. The closing body, together with a conical first valve seat of the valve chamber, forms a seal resistant to high pressure. When the actuator is deflected, the closing body is lifted off from the first valve seat, with the result that the servovalve opens (2/2-way valve). In another embodiment, a further conical sealing seat located opposite the first valve seat in the axial direction is disposed in the valve chamber, and, when the actuator is in the deflected state, the closing body covers the further valve seat, thus giving rise to a hydraulic stop (3/2-way valve).

SUMMARY OF THE INVENTION

It is accordingly an object of the invention to provide a fuel injection valve for internal combustion engines, which overcome the above-mentioned disadvantages of the prior art devices and methods of this general type, which has an improved configuration of a servovalve.

With the foregoing and other objects in view there is provided, in accordance with the invention, a fuel injection valve, including:

an inflow duct;

a nozzle body having a control chamber formed therein, the control chamber is connected to the inflow duct;

a nozzle needle disposed at least partially in the control chamber, a pressure in the control chamber being operatively connected to the nozzle needle, and the pressure in the control chamber controls the nozzle needle;

a return duct;

a servovalve disposed between the control chamber and the return duct, the servovalve has a closing body and an associated valve seat, in a closed position of the servovalve the closing body closes an outflow, the closing body has a closing head in a form of a part-sphere and associated with the valve seat, the closing body further has a closing stem merging with the closing head, the servovalve has a valve spring surrounding the closing stem that pre-stresses the closing head against the valve seat; and an actuator for actuating the closing body.

One advantage of the invention is that the useful life of the servovalve is increased. Another advantage is the small build of the servovalve and the simple method of producing the closing body.

The special shaping of the closing body as a rotationally symmetric body is advantageous, the latter having a i termination in the form of a part circle on one end face (head) and merging in the longitudinal direction, toward the opposite end face, into a slender stem of a smaller diameter. The cross-sectional shape of the closing body is formed to be approximately mushroom-shaped.

The head of the closing body preferably has a central flattening, on which a tappet connected to the actuator rests. An enlarged effective area between the tappet and the closing body is thereby achieved, thus advantageously leading to lower wear and less risk of tilting of the closing body.

The stem of the closing body is surrounded by the valve spring which pre-stresses the closing body in a direction of the first valve seat. The compact overall size of the servovalve and stabilization of the closing body are advantageously achieved as a result.

The stem of the closing body is terminated in the form of a part-sphere, the part-sphere shape advantageously serving, together with a sealing seat, as a sealing surface.

The closing body is preferably produced from a solid sphere. This results in low production tolerances and a simple production method.

Other features which are considered as characteristic for the invention are set forth in the appended claims.

Although the invention is illustrated and described herein as embodied in a fuel injection valve for internal combustion engines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
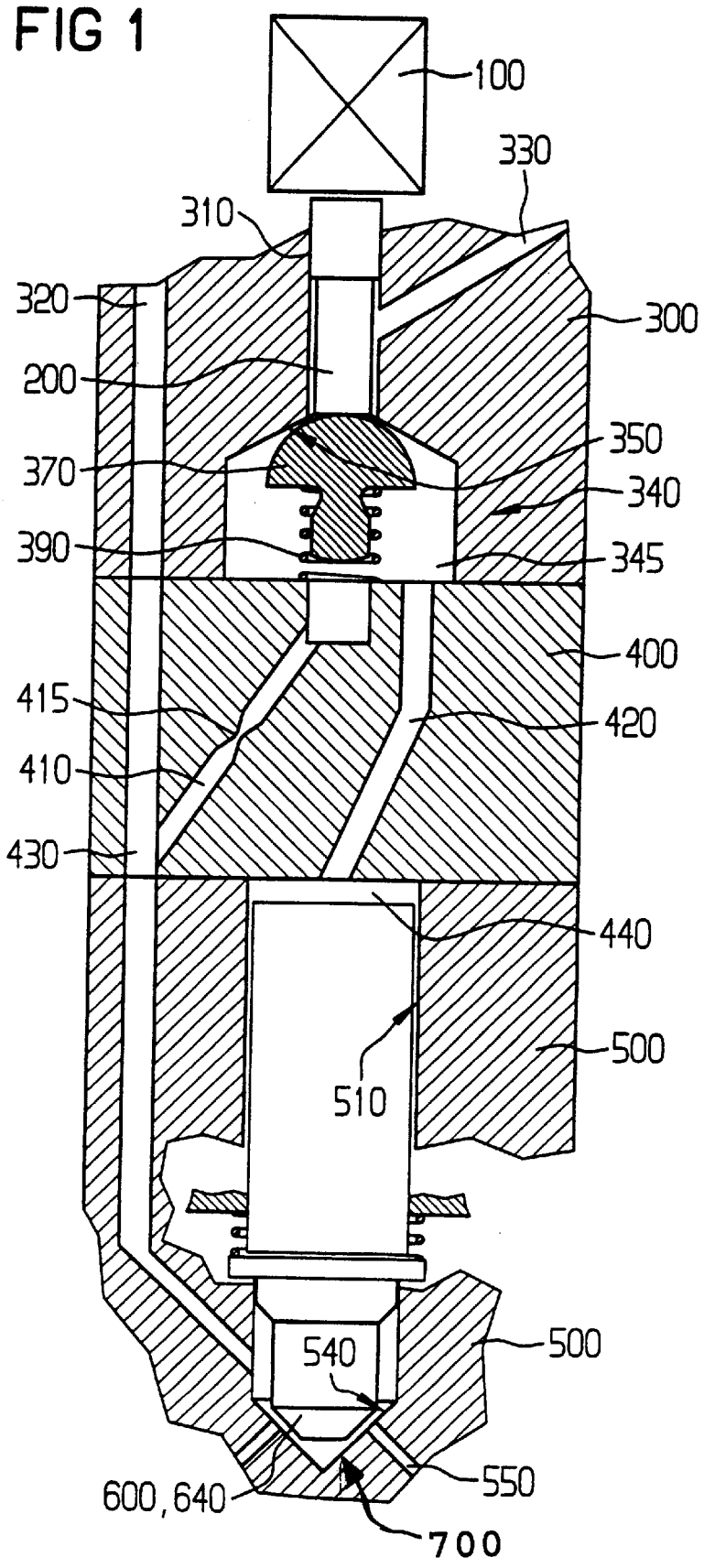
FIG. 1 is a diagrammatic, longitudinal section view through a fuel injection valve with a servovalve in a first embodiment according to the invention.

In all the figures of the drawing, sub-features and integral parts that correspond to one another bear the same reference symbol in each case. Referring now to the figures of the drawing in detail and first, particularly, to FIG. 1 thereof, there is shown a fuel injection valve with a 2/2-way valve (a servovalve). The fuel injection valve having a basic body of a rotationally symmetric shape is subdivided axially in a longitudinal direction into various bodies.

A controllable actuator 100, preferably a piezoelectric actuator, is operatively connected to a closing body 370 via a tappet 200. The tappet 200 is guided in a central guide bore 310 of a servobody 300. The servobody 300 additionally has a fuel duct 320, a return duct 330 and a central valve chamber 345. The return duct 330 projects laterally into the guide bore 310 and is connected to a fuel tank. The guide bore 310 merges via a conically opening first valve seat 350 into the valve chamber 345. The closing body 370 is introduced in the valve chamber 345 and, together with the first valve seat 350, forms, in a closed state, a seal resistant to high pressure. The closing body 370 is shaped in the form of a mushroom, a stem of the closing body 370 being surrounded by a valve spring 390 which is disposed in the valve chamber 345 and which exerts on the closing body 370 a spring force directed toward the first valve seat 350.

Figure 3:
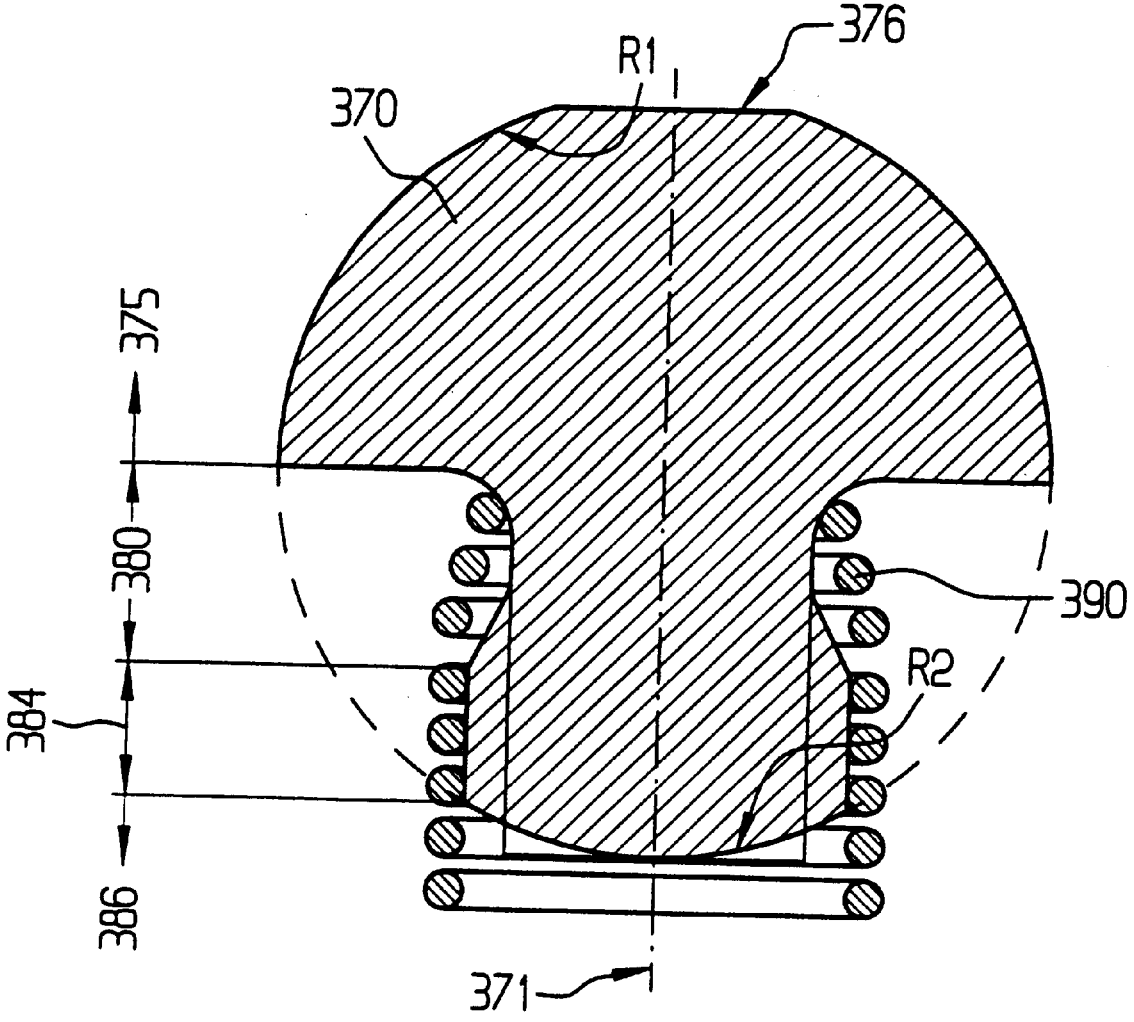
FIG. 3 is a cross-sectional view of a closing body with a valve spring.

The shape of the closing body 370 is explained in more detail in the description of FIG. 3.

The valve chamber 345, the closing body 370, the valve spring 390 and the first valve seat 350 form a servovalve 340 which is activated by the actuator 100 via the tappet 200. By the actuator 100 being deflected out of a state of rest, the servovalve 340 opens, with the result that a hydraulic connection (outflow) between the valve chamber 345 and the fuel tank is made via the guide bore 310 and the return duct 330. On a side located opposite the guide bore 310, the valve chamber 345 is delimited by an intermediate body 400 which adjoins the servobody 300 in the axial direction.

The intermediate body 400 has a fuel duct 430, a connecting duct 420 and an inflow duct 410 which connects the fuel duct 430 to the valve chamber 345 and which has an inflow throttle 415 restricting the flow of fuel into the valve chamber 345.

A nozzle body 500 axially adjoining the intermediate body 400 has a central nozzle guide 510, in which a nozzle needle 600 is guided in the axial direction. The nozzle needle 600 and the nozzle body 500 form, with a valve tip 640 and with a conically tapering second valve seat 540 respectively, a valve 700 that controls the injection of fuel into a combustion space via one or more spray holes 550 disposed at the tip of the nozzle body 500. Worked into the nozzle needle 600 are annular shoulders which, by a fuel pressure, exert on the nozzle needle 600 an axial force directed away from the second valve seat 540.

A rear side of the nozzle needle 600 projects into a control chamber 440 which is connected to the valve chamber 345 via the connecting duct 420. The pressure in the control chamber 440 exerts on the nozzle needle 600 an axial force directed toward the second valve seat 540.

A movement of the nozzle needle 600 directed axially toward the intermediate body 400 opens the valve 700, and a movement in the opposite direction closes the valve 700.

The opening of the servovalve 340 causes the fuel to flow from the valve chamber 345 via the guide bore 310 and the return duct 330 into the fuel tank. Due to the inflow throttle 415 in the inflow duct 410, it is not possible for fuel to continue to flow sufficiently to maintain the fuel pressure in the valve chamber 345 and in the control chamber 440 connected to the latter via the connecting duct 420. The reduced pressure in the control chamber 440 leads to a deflection of the nozzle needle 600 away from the second valve seat 540 and therefore to the start of the injection operation. If the actuator 100 is drawn back into its position of rest, the closing body 370 returns to the first valve seat 350 on account of the pressure difference between the valve chamber 345 and the return duct 330 and on account of the restoring force of the valve spring 390 and breaks the hydraulic connection between the valve chamber 345 and the return duct 330 (closed position). The fuel continues to flow out of the fuel duct 430 via the inflow throttle 415 into the valve chamber 345 and the control chamber 440, with the result that the high pressure is built up again in the control chamber 440. The valve needle 600 is thereby pressed onto the second valve seat 540, so that the injection operation through the spray holes 550 is terminated.

Figure 2:
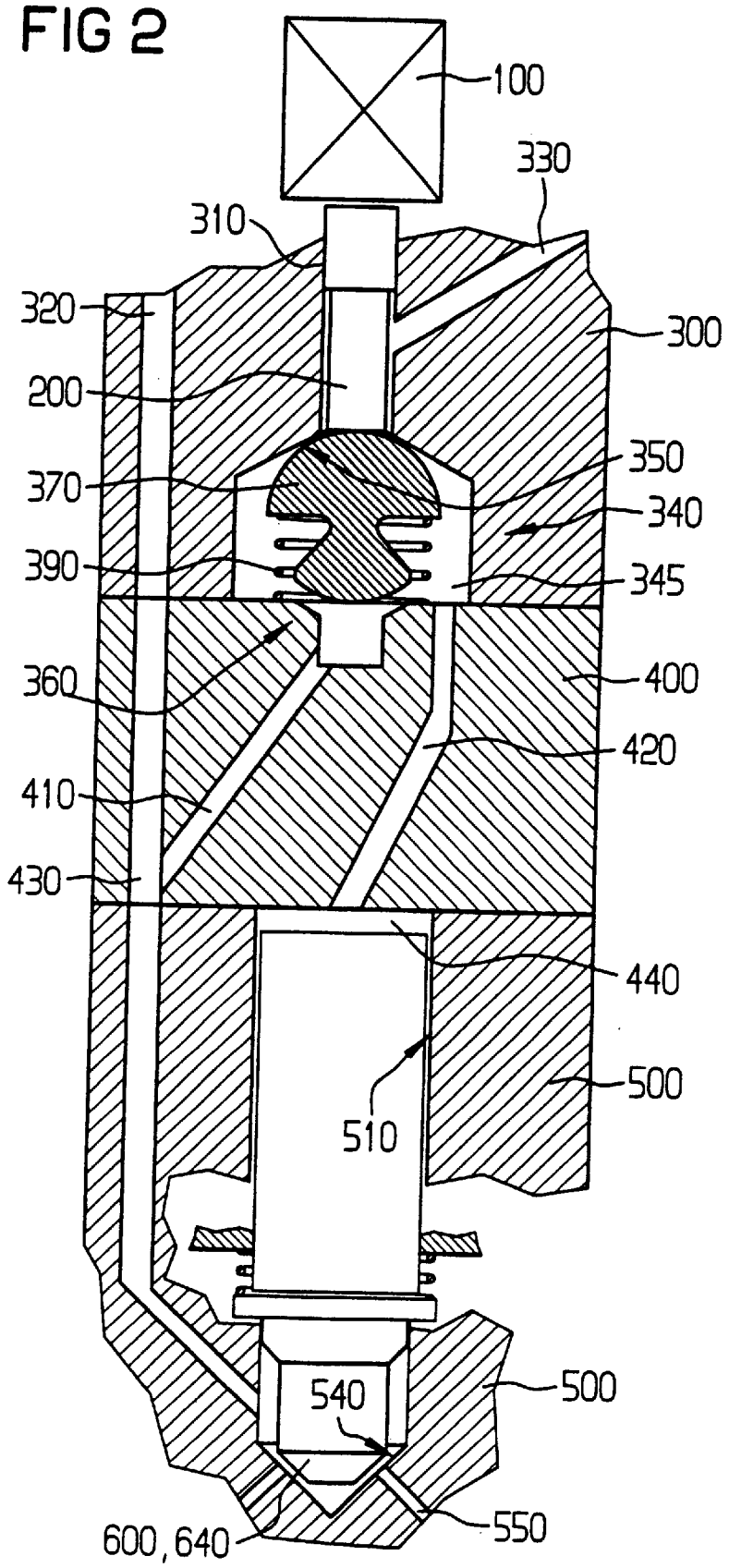
FIG. 2 is a longitudinal section view through the fuel injection valve with the servovalve in a second embodiment.

FIG. 2 shows the fuel injection valve from FIG. 1 with a 3/2-way valve (servovalve). In contrast to the fuel injection valve from FIG. 1, there is no inflow throttle 415 in the inflow duct 410. Furthermore, in contrast to FIG. 1, the valve chamber 345 has, at an end located opposite the first valve seat 350, a conically tapering sealing seat 360 which, in conjunction with the lower body part of the closing member 370, a closing foot 386 (see FIG. 3), forms a seal resistant to high pressure. With the actuator 100 deflected, that is to say with the outflow open, the seal closes off the inflow duct 410 hydraulically from the valve chamber 345.

This 3/2-way valve functions as now described. When the actuator 100 is in the non-deflected state, the control chamber 400 is connected hydraulically to the fuel in the fuel duct 430, the fuel being under high pressure. The hydraulic connection between the valve chamber 345 and the return duct 330 is broken. When the actuator 100 is in the deflected state, the connection between the inflow duct 410 and the valve chamber 345 is broken, and the control chamber 440 is connected hydraulically to the return duct 330 via the valve chamber 345. By virtue of the deflection of the actuator 100, therefore, a rapid pressure drop is achieved in the control chamber 440, with the result that a rapid opening of the fuel injection valve is obtained. If the actuator 100 returns from the deflected state into its state of rest, the control chamber 440 builds up its pressure again, via the valve chamber 345 and the inflow duct 410, rapidly and without being inhibited by any inflow throttle 415, with the result that a rapid termination of the fuel injection operation is achieved. Moreover, the fuel quantity flowing out via the return duct 330 when the servovalve 340 is open is reduced.

FIG. 3 shows a cross section of the closing body 370 with the valve spring 390 in a preferred embodiment.

The closing body 370 is configured to be rotationally symmetrical along its longitudinal axis 371. The closing body 370 is subdivided axially, as seen from the tappet 200 in FIG. 1, into a closing head 375, an indentation 380, a closing stem 384 and the closing foot 386.

The closing body 375 is configured, on the same side as the first valve seat 350, in the form of a part-sphere with a first radius R1 and has a central, preferably circular head flattening 376, with the result that the tappet 200 has a bearing surface which is enlarged, as compared with the pure part-sphere shape. The end face, with which the tappet 200 rests on the head flattening 376, is likewise made planar, so that the tappet 200 rests over a large area on the head flattening 376. Advantageously, a lower load on the material of the closing body 370 and of the tappet 200 and therefore lesser abrasion of the material are achieved due to the enlarged bearing surface, thus making an increased useful life possible. Furthermore, the head flattening 376 achieves improved guidance of the closing body 370 by the tappet 200, since the end face of the tappet 200 is disposed parallel to the head flattening 376.

The closing head 375 has, on its underside located axially opposite the head flattening 376, a shoulder which leads to a reduction in the diameter and which constitutes the start of the indentation 380. Further on in the axial direction, the shoulder merges via a rounding into a cylindrical stem which widens conically via a further rounding and which merges via a first annular edge into the cylindrical closing stem 384 of a widened diameter. The closing stem 384 ends at a further annular edge and merges into the closing foot 386 which terminates the closing stem 384 preferably in the form of a part-sphere with a second radius R2.

The indentation 380 is formed essentially by an annular recess.

The first radius R1 is preferably equal to the second radius R2, since the closing body 370 is produced from a solid sphere which is indicated by the broken line depicted in FIG. 3. The solid sphere consists preferably of metal and is machined by milling, lathe-turning or the like, in such a way as to produce the closing body 370, this advantageously being a simple method for producing the closing body 370. The surfaces of the closing body 370 which are in the form of a part-sphere are configured in such a way that, together with the first valve seat 350 or the sealing seat 360, they in each case make it possible to have a seal resistant to high pressure. The part-sphere shape advantageously allowing sealing even when the closing body 370 is tilted slightly. The surfaces of the faces of the part-sphere have a slight roughness, in order to make the seals resistant to high pressure. Advantageously, low production tolerances, particularly in the region of the sealing surfaces, are achieved by the closing body 370 being shaped out of a solid sphere.

The indentation 380 and the closing stem 384 are surrounded by the valve spring 390. The valve spring 390 rests at one end on the intermediate body 400 (the bottom of the valve chamber 345, see FIG. 1 or FIG. 2) and at the other end on the underside of the closing head 375. The spring force of the valve spring 390 presses the closing body 370 against the first valve seat 350 and the tappet 300. The indentation 380 serves to ensure that one end face of the valve spring 390 bears approximately perpendicularly on the underside of the closing head 375, and, advantageously, essentially axial forces are thus exerted on the spring. Furthermore, the valve spring 390 snaps into the indentation 380 and is thus advantageously connected to the closing member 370 in a mechanically firm manner.

The configuration of the valve spring 390 and of the closing body 370 in relation to one another makes it possible, advantageously, for the servovalve 340 to have a compact build.

The valve spring 390 bears preferably closely on the closing stem 384, so that the valve spring 390 and the closing body 370 are stabilized laterally.

An advantageous stabilized guidance of the closing body 370 improves the dynamic behavior of the servovalve 340 and accelerates the opening and closing of the latter, this being achieved by the below recited.

The tappet 200 rests with its end face on the head flattening 376 and exerts a stabilizing force on the closing body 370, this force making it more difficult for the closing body 370 to tilt.

The valve spring 390 bears annularly with one end face on the underside of the closing head 375 and with the opposite end face on the bottom of the valve chamber 345. The closing body 370 is stabilized because the spring force of the valve spring 390 is directed axially and acts annularly in a uniform manner on the bottom of the valve chamber 345 and on the underside of the closing head 375.

The valve spring 390 closely surrounds the closing stem 384 and thus prevents the closing body 370 from tilting.

The valve spring 390 is configured preferably as a helical spring or as a hollow spring.

We claim:

1. A fuel injection valve, comprising:

an inflow duct;

a nozzle body having a control chamber formed therein, said control chamber connected to said inflow duct;

a nozzle needle disposed at least partially in said control chamber, a pressure in said control chamber being operatively connected to said nozzle needle, and the pressure in the control chamber controlling said nozzle needle;

a return duct;

a servovalve disposed between said control chamber and said return duct, said servovalve having a closing body and an associated valve seat, in a closed position of said servovalve said closing body closing an outflow, said closing body having a closing head in a form of a part-sphere and associated with said valve seat, said closing body having a central head flattening associated with said valve seat, said closing body further having a closing stem merging with said closing head, said servovalve having a valve spring surrounding said closing stem and pre-stressing said closing head against the valve seat;

a tappet guided by said valve seat; and an actuator for actuating said closing body, said actuator being operatively connected to said tappet which in turn bears on said central head flattening.

2. The fuel injection valve according to claim 1, wherein said closing stem has a closing foot terminating said closing stem in a form of a part-sphere.

3. The fuel injection valve according to claim 2, including an intermediate body with a sealing seat formed therein disposed opposite said valve seat and said inflow duct also disposed in said intermediate body, said sealing seat and said closing foot forming a seal resistant to high pressure if the outflow is open.

4. The fuel injection valve according to claim 2, wherein said closing head has a radius and said closing foot has a radius equal to said radius of said closing head.

5. The fuel injection valve according to claim 1, wherein said closing body has an indentation formed therein and said valve spring snaps into said indentation.

6. A method for producing a closing body for a fuel injection valve according to claim 1, which comprises:

providing a solid sphere body; and introducing recesses into the solid sphere body forming a closing head having a part-sphere shape and a closing stem merging from said closing head, the closing stem shaped for receiving a valve spring.

7. A fuel injection valve, comprising:

an inflow duct;

a nozzle body having a control chamber formed therein, said control chamber connected to said inflow duct;

a nozzle needle disposed at least partially in said control chamber, a pressure in said control chamber being operatively connected to said nozzle needle, and the pressure in the control chamber controlling said nozzle needle;

a return duct;

a servovalve disposed between said control chamber and said return duct, said servovalve having a closing body and an associated valve seat, in a closed position of said servovalve said closing body closing an outflow, said closing body having a closing head in a form of a part-sphere and associated with said valve seat, said closing body further having a closing stem merging with said closing head, said closing stem having a closing foot terminating said closing stem in a form of a part-sphere, said servovalve having a valve spring surrounding said closing stem and pre-stressing said closing head against the valve seat; and an actuator for actuating said closing body.

8. A method for producing a closing body for a fuel injection valve according to claim 7, which comprises:

providing a solid sphere body; and introducing recesses into the solid sphere body forming a closing head having a part-sphere shape and a closing stem merging from said closing head, the closing stem shaped for receiving a valve spring.

9. The fuel injection valve according to claim 7, including an intermediate body with a sealing seat formed therein disposed opposite said valve seat and said inflow duct also disposed in said intermediate body, said sealing seat and said closing foot forming a seal resistant to high pressure if the outflow is open.

10. The fuel injection valve according to claim 7, wherein said closing head has a radius and said closing foot has a radius equal to said radius of said closing head.

11. The fuel injection valve according to claim 7, wherein said closing body has an indentation formed therein and said valve spring snaps into said indentation.

* * * * *